US009381927B2

(12) United States Patent
Dimmer et al.

(10) Patent No.: US 9,381,927 B2
(45) Date of Patent: Jul. 5, 2016

(54) TRAIN DETECTION SYSTEM AND METHOD OF DETECTING TRAIN MOVEMENT AND LOCATION

(75) Inventors: David Dimmer, Toronto (CA); Abe Kanner, Mississauga (CA)

(73) Assignee: Thales Canada Inc., Toronto, Ontario (CA)

( * ) Notice: Subject to any disclaimer, the term of this patent is extended or adjusted under 35 U.S.C. 154(b) by 438 days.

(21) Appl. No.: 13/544,965

(22) Filed: Jul. 9, 2012

(65) Prior Publication Data

US 2014/0012439 A1 Jan. 9, 2014

(51) Int. Cl.
*B61L 25/02* (2006.01)

(52) U.S. Cl.
CPC ..... *B61L 25/025* (2013.01)

(58) Field of Classification Search
CPC ..... B61L 15/0072; B61L 27/04; B61L 25/02; B61L 13/00; B61L 3/24; G05D 1/00; B61B 1/00
USPC ..... 701/19
See application file for complete search history.

(56) References Cited

U.S. PATENT DOCUMENTS

| | | | | | |
|---|---|---|---|---|---|
| 5,098,044 | A * | 3/1992 | Petit et al. | ..... | 246/187 A |
| 5,332,180 | A * | 7/1994 | Peterson et al. | ..... | 246/3 |
| 5,729,213 | A * | 3/1998 | Ferrari et al. | ..... | 340/901 |
| 5,983,161 | A * | 11/1999 | Lemelson et al. | ..... | 701/301 |
| 6,135,396 | A * | 10/2000 | Whitfield et al. | ..... | 246/182 R |
| 6,195,020 | B1 * | 2/2001 | Brodeur et al. | ..... | 340/933 |
| 6,876,907 | B2 * | 4/2005 | Kanner et al. | ..... | 701/19 |
| 8,477,067 | B2 * | 7/2013 | Kanner | ..... | 342/357.29 |
| 8,483,895 | B1 * | 7/2013 | Beregi | ..... | 701/20 |
| 8,548,655 | B2 * | 10/2013 | Kanner | ..... | 701/19 |
| 2002/0062182 | A1 * | 5/2002 | Sato et al. | ..... | 701/19 |

* cited by examiner

*Primary Examiner* — McDieunel Marc
*Assistant Examiner* — James E Stroud
(74) *Attorney, Agent, or Firm* — Hauptman Ham, LLP

(57) ABSTRACT

A train detection system for detecting a train unit that includes a first transponder interrogator configured to generate one or more request signals for transmission, by a first antenna above a first track location, toward a first fixed transponder at the first track location; a second transponder interrogator configured to generate one or more request signals for transmission, by a second antenna above a second track location, toward a second fixed transponder at the second track location; and a controller communicably connected with the first and second transponder interrogators and configured to verify operation of the train detection system based on receipt of one or more message signals responsive to transmission of the one or more request signals from the first and second transponder interrogators.

31 Claims, 5 Drawing Sheets

TRAIN DETECTION SYSTEM AND METHOD OF DETECTING TRAIN MOVEMENT AND LOCATION

BACKGROUND

In train systems, the detection of train movement and direction is used to manage traffic between trains. It is also used to determine location of train units of the train systems in storage locations.

In some existing train systems, the detection of train movement is typically performed by a communication-based train control (CBTC) system in which vehicle on-board controllers (VOBC) of each train unit when in operation communicate with the wayside Zone Controller to detect train movement and identify the location of each train in storage locations.

There are other existing methods used to detect train movement via a secondary detection system by use of axle counters and track circuits. The secondary detection system is used in train systems that include train units equipped with steel wheels and traveling on steel rails. Track circuits detect when train units shunt the steel rails, and axle counters detect and count steel axles when passing, via the detection head of the secondary detection system.

Some train systems have non-steel (e.g., rubber) tire systems such as monorails, and the secondary detection system is not suitable for detecting train movement in these train systems. In such cases, some existing methods require simulation of steel wheel-to-steel rail interface so that the secondary detection system may be used. In yet another existing method, a position of the train units in storage locations is identified manually by a physical connection (e.g., a plug) between the train and the storage location. In these existing methods, train movement is detected; however, the direction of the movement is undetectable.

DESCRIPTION OF THE DRAWINGS

One or more embodiments are illustrated by way of example, and not by limitation, in the figures of the accompanying drawings, wherein elements having the same reference numeral designations represent like elements throughout and wherein.

DETAILED DESCRIPTION

One or more embodiments of the present disclosure include a train detection system for determining train movement, direction of movement, and/or location within storage locations, depots or stations, or along track locations, without in some embodiments the use of a primary train detection system or manual detection, and irrespective in other embodiments of whether a vehicle on-board controller (VOBC) of each train is operational and independent of the wheel/rail interface. In one or more embodiments, the train detection system uses a combination of radio frequency identification (RFID) transponders and readers (e.g., transponder interrogators) to detect a train unit having a non-operational VOBC while parked in the storage locations. In one or more embodiments, the train detection system further enables an initiation of positioning of an operational VOBC of a train unit, without the need to have the corresponding train unit move to initiate the positioning.

Figure 1:
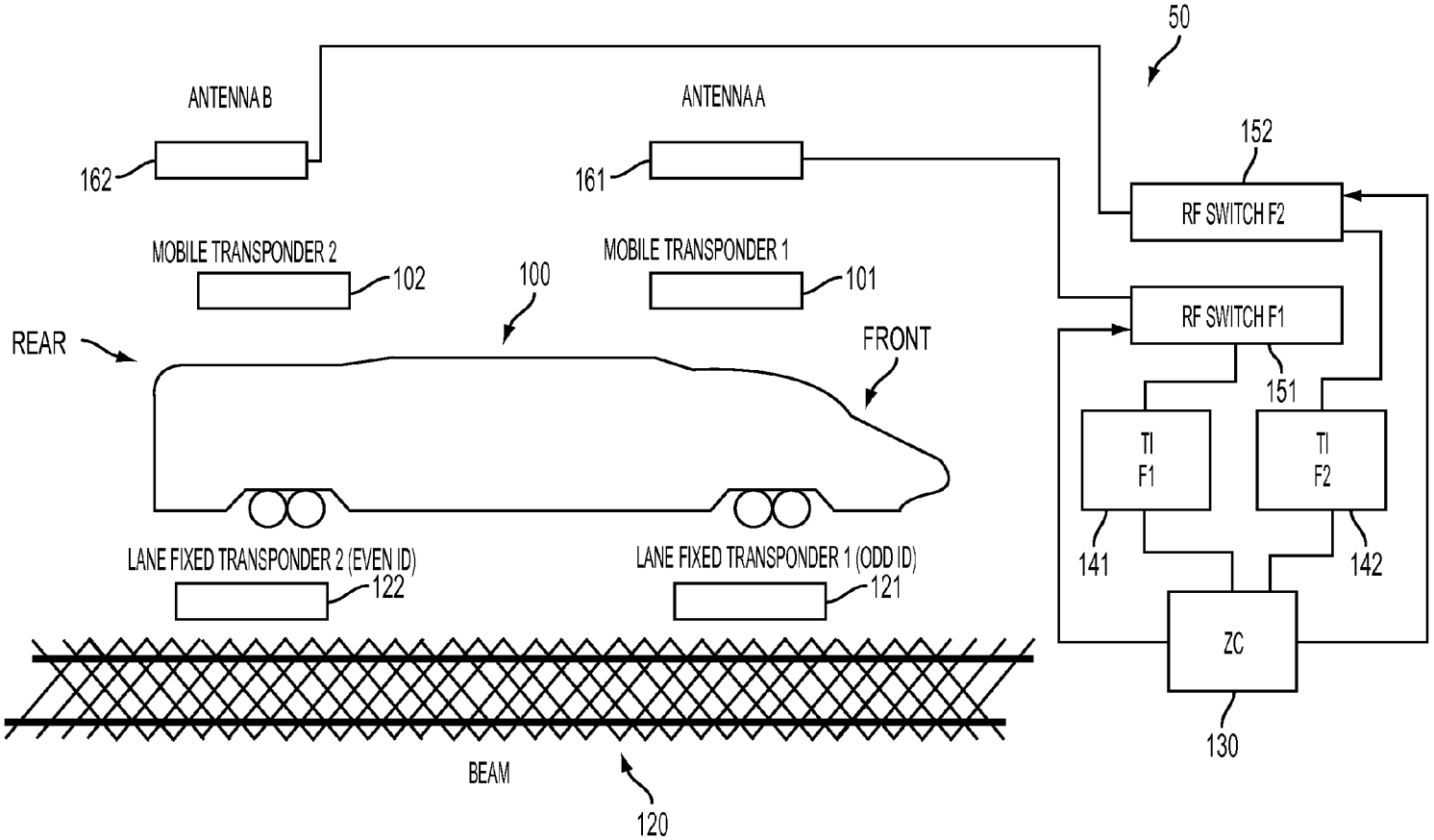
FIG. 1 is a high level functional diagram of a train detection system including a train unit in accordance with one or more embodiments.

FIG. 1 is a diagram of a train detection system 50 including a train unit 100 in accordance with one or more embodiments. The train detection system includes a pair of mobile transponders including a first mobile transponder 101 and a second mobile transponder 102 mounted at opposite ends on the train unit 100. The first mobile transponder 101 is positioned at a front end of the train unit 100 and the second mobile transponder 102 is positioned at a rear end of the train unit 100. The first and second mobile transponders 101 and 102 are mounted at a predetermined position (e.g., a top surface) on the train unit 100.

The train detection system 50 further includes a pair of fixed transponders that includes a first fixed transponder 121 and a second fixed transponder 122. The first and second fixed transponders 121 and 122 are mounted at a location 120, for example, at a beam at a track location or a storage location. As shown, the first fixed transponder 121 corresponds to the location of the first mobile transponder 101 and the second fixed transponder 122 corresponds to the second mobile transponder 102 of the train unit 100, when the train unit 100 is parked at the location 120. The first and second fixed transponders 121 and 122 are at a predetermined distance apart such that the first and second mobile transponders 101 and 102 of the train unit 100 block the first and second fixed transponders 121 and 122 from being read, when the train unit 100 is parked at the location 120. According to one or more embodiments, the first and second fixed transponders 121 and 122 each comprise a unique identifier used to identify the corresponding transponder 121 and 122 in response to a request when scanned by a reader.

According to one or more embodiments, the first and second mobile transponders 101 and 102 and the first and second fixed transponders 121 and 122 are wireless communication devices which emit unique identifiers. In one or more embodiments, the mobile transponders 101 and 102 and first and second fixed transponders 121 and 122 are passive transponders which do not include a power source and are activated by an incoming signal received from a reader (e.g., a transponder interrogator) to emit the unique identifiers. In one or more other embodiments, the first and second mobile transponders 101 and 102 and the first and second fixed transponders 121 and 122 are active transponders each having an on-board power source for emitting the unique identifiers. According to one or more embodiments, the first and second mobile transponders 101 and 102 and the first and second fixed transponders 121 and 122 are transponder units available from TagMaster of Kista, Sweden.

The train detection system 50 further includes a controller 130 (e.g., a zone controller), first and second transponder interrogators 141 and 142, first and second RF switch devices 151 and 152, and first and second antennas 161 and 162 above the location 120.

According to one or more embodiments, the first and second transponder interrogators 141 and 142 operate by sending radio frequency triggering signals between corresponding first and second antennas 161 and 162 and corresponding first and second fixed transponders 121 and 122, or the first and second mobile transponders 101 and 102 if the train unit 100 is parked at the location 120. The radio frequency triggering signals activate the first and second fixed transponders 121 and 122 and the first and second mobile transponders 101 and 102, to emit a response signal including a unique identifier. According to one or more embodiments, the first and second transponder interrogators 141 and 142 are transponder interrogator units available from TagMaster of Kista, Sweden.

The controller 130 transmits a control signal to the first and second RF switches 151 and 152 to select the corresponding first and second antennas 161 and 162 for performing scanning of the first and second fixed transponders 121 and 122 or the first and second mobile transponders 101 and 102 if a train unit 100 is present. The first and second transponder interrogators 141 and 142 then perform a scanning operation of the first and second fixed transponders 121 and 122 or the first and second mobile transponders 101 and 102 via the selected first and second antennas 161 and 162.

During the scanning process, the first transponder interrogator 141 repeatedly transmits via the first antenna 161 a request signal (i.e., the radio frequency trigger signal) in a direction of the first fixed transponder 121; and the second transponder interrogator 142 repeatedly transmits via the second antenna 162 a request signal in a direction of the second fixed transponder 122 which is different from the direction of the first fixed transponder 121.

According to one or more embodiments, the first and second transponder interrogators 141 and 142 operate at different frequencies to avoid interference between each other. According to one or more embodiments, the request signals are sent either periodically or continuously over a predetermined period of time. Since the first and second fixed transponders 121 and 122 are scanned independently by the first and second transponder interrogators 141 and 142, via first and second antennas 161 and 162, it is possible to determine whether the first and second fixed transponders 121 and 122 are read correctly and therefore operability of the first and second transponder interrogators 141 and 142, the first and second switch devices 151 and 152, the fixed transponders 121 and 122 and the first and second antennas 161 and 162 is detectable. If the storage unit 100 is unoccupied, the first and second fixed transponders 121 and 122 receive the request signals and are activated by the request signals, and each first and second fixed transponder 121 and 122 sends a response signal that includes a unique identifier back to the first and second transponder interrogator 141 and 142 for processing, to identify the first and second fixed transponders 121 and 122. Upon processing the response signals, the first and second transponder interrogators 141 and 142 send message signals corresponding to the first and second fixed transponders 121 and 122, to the controller 130 to verify operation of the train detection system 50. According to one or more embodiments, the controller 130 verifies operation of the first and second fixed transponders 121 and 122 and the first and second transponder interrogators 141 and 142.

If the location 120 is occupied as shown in FIG. 1, the first and second mobile transponders 101 and 102 receive the request signals and are activated instead of the first and second fixed transponders 121 and 122, as the first and second fixed transponders 121 and 122 are blocked by the body of the train unit 100. The first and second mobile transponders 101 and 102 each send a response signal back to the first and second transponder interrogators 141 and 142, and the first and second transponder interrogators 141 and 142 process the response signals and then send message signals to the controller 130 to be processed.

According to one or more embodiments, the train detection system 50 operates in a continuous cycle, and because first and second transponder interrogators 141 and 142 are repeatedly generating request signals, and a request signal is periodically or continuously transmitted from the first and second antennas 161 and 162 to the first and second fixed transponders 121 and 122, any failure within the train detection system 50 is easily detected thereby making the train detection system 50 checked-redundant.

Therefore, according to one or more embodiments, the first and second antennas 161 and 162 are configured to communicate with the first and second fixed transponders 121 and 122 of the location 120 or the first and second mobile transponders 101 and 102 of the train unit 100 if the location 120 is occupied.

According to one or more embodiments, the first and second transponder interrogators 141 and 142 are isolated from each other such that no common failure mode would affect both first and second transponder interrogators 141 and 142.

Figure 3:
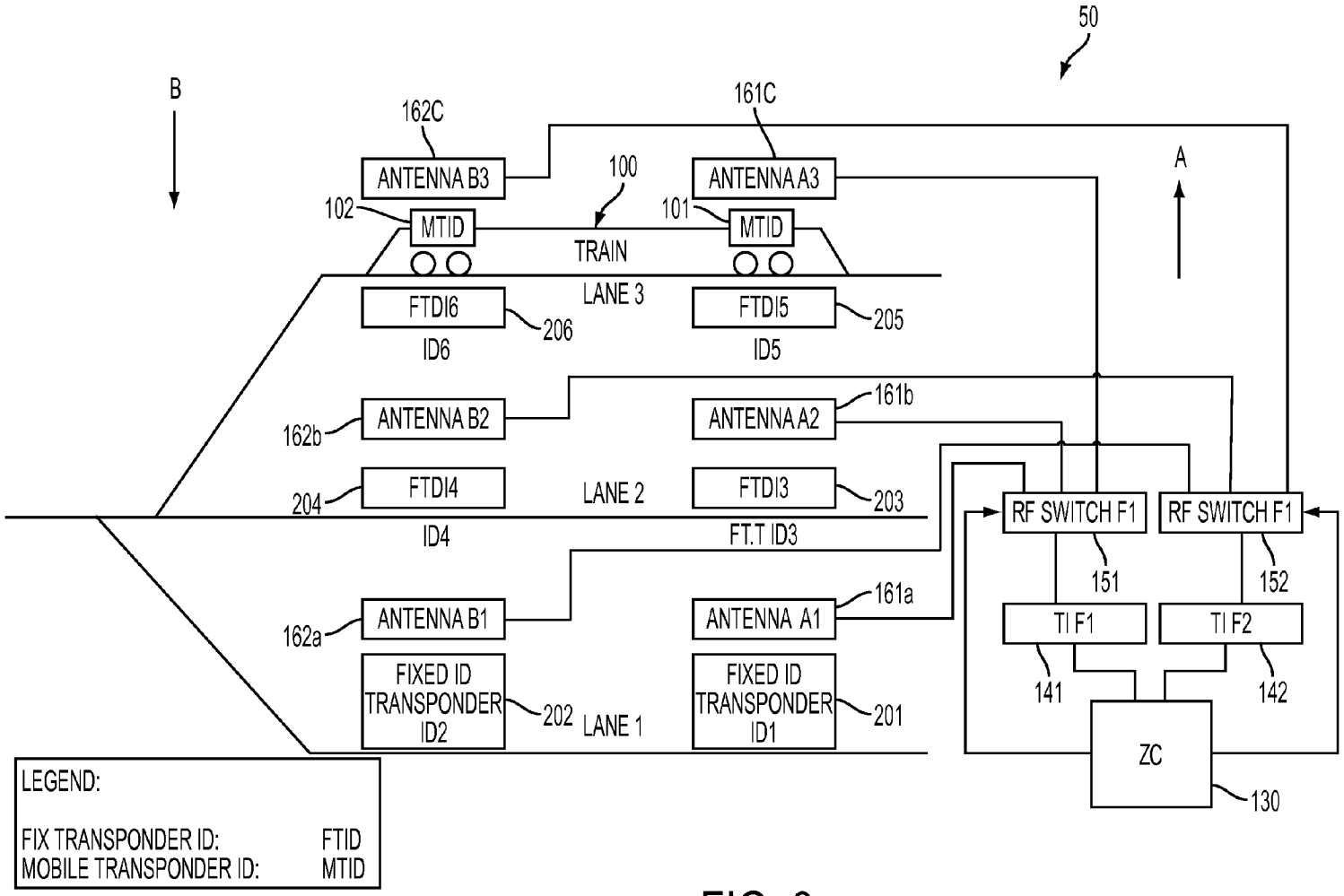
FIG. 3 is a high level diagram of a train detection system including a stored train unit and storage locations in accordance with one or more embodiments.

Although only one first antenna 161 and one second antenna 162 are shown, the first and second switch devices 151 and 152 are used to switch between multiple first antennas and second antennas 161 and 162 corresponding to a plurality of storage locations (as depicted in FIG. 3).

Further, according to one or more embodiments, two transponder interrogators are provided however the present disclosure is not limited hereto and may vary as needed. For example, if detecting the location of a train unit 100 at a depot or station, an additional transponder interrogator is required due to the distance between the storage locations and the depot or station. According to one or more embodiments a single transponder interrogator and RF switch device are used to read the first and second fixed transponders 121 and 122 on one or more locations 120.

According to one or more embodiments, the controller 130 controls the first and second RF switch devices 151 and 152, and receives, and processes message signals from the first and second transponder interrogators 141 and 142 to verify operation of the train detection system 50. The controller 130 also controls the VOBC of a train unit 100 in accordance with one or more embodiments.

Figure 2:
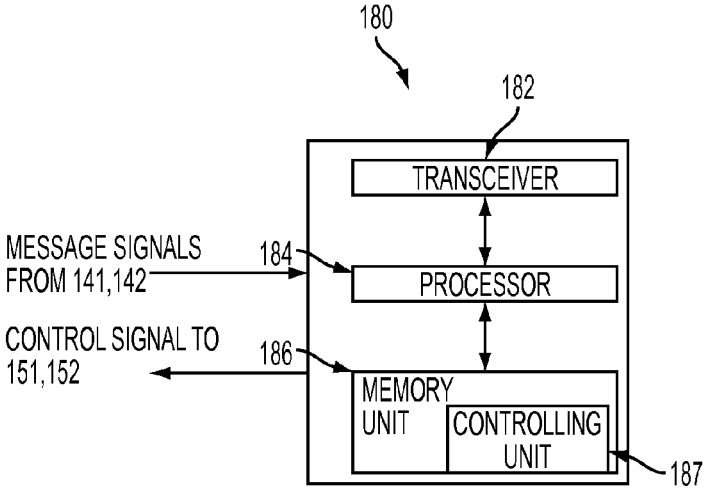
FIG. 2 is a high level block diagram of a controller usable in conjunction with the train detection system of FIG. 1 in accordance with one or more embodiments.

FIG. 2 is a high level block diagram of an example of a controller 180 usable as controller 130 in accordance with one or more embodiments. The controller 180 comprises a transceiver 182, a processor 184, and a memory unit 186 having a controlling unit 187 and connected to the processor 184. In at least some embodiments, controller 180 components are communicably connected via a bus or other intercommunication mechanism. The controller 180 will be normally used in a checked-redundant fail-safe configuration where two or more controllers work in tandem.

Transceiver 182 receives message signals from the first and second transponder interrogators 141 and 142. The transceiver 182 also transmits the control signals to the first and second RF switch devices 151 and 152 to periodically switch between multiple first and second antennas 161 and 162. In at least some embodiments, transceiver 182 comprises a mechanism for connecting to a network. In at least some other embodiments, controller 180 comprises more than a single transceiver 182. In at least some embodiments, transceiver 182 comprises a wired and/or wireless connection mechanism. In at least some embodiments, controller 180 connects via transceiver 184 to one or more additional controllers. According to one or more embodiments, a separate receiver and a separate transmitter are provided to separately receive message signals from/to the first and second transponder interrogators 141 and 142 and transmit control signals to the first and second RF switch devices 151 and 152.

Processor 184 is a processor, programmed/programmable logic device, application specific integrated circuit or other similar device configured to execute a set of instructions to perform one or more functions according to an embodiment. In at least some embodiments, processor 184 is a device configured to interpret a set of instructions to perform one or more functions. Processor 184 processes signals received by the train unit 100.

Memory unit 186 (also referred to as a computer-readable medium) comprises a random access memory (RAM) or other dynamic storage device, coupled to processor 184. The memory unit 186 stores data and/or instructions from the controlling unit 187, to be executed by processor 184 for verifying operation of the first and second fixed transponders 121 and 122 and determining train location and movement, based on the message signals received from the first and second transponder interrogators 141 and 142. Memory unit 186 is also used for storing temporary variables or other intermediate information during execution of instructions to be executed by processor 184. In at least some embodiments, memory unit 186 comprises a read only memory (ROM) or other static storage device coupled to the processor 184 for storing static information or instructions for the processor 184.

In at least some embodiments, a storage device, such as a magnetic disk, optical disk, or electromagnetic disk, is provided and coupled to the processor 184 for storing data and/or instructions.

In at least some embodiments, one or more of the executable instructions for determining train location and movement are stored in one or more memories of other controllers communicatively connected with controller 180. In at least some embodiments, a portion of one or more of the executable instructions for determining train location and movement are stored among one or more memories of other computer systems. The controller 180 communicates with the transponder interrogators 141 and 142 which receive identifier information within the response signals from the fixed transponders 121 and 122 and the mobile transponders 101 and 102, and the controller 180 processes the message signals via the processor 184, and determines a location and movement of the train unit 100. The present disclosure is not limited to the controller 180 including the elements 182, 184, 186 and 187 as shown in FIG. 2 and according to one or more embodiments includes other elements suitable for performing functions of the controller 180 as set forth herein.

The train detection system 50 according one or more embodiments is used to detect the location of train units stored within multiple storage locations (Lanes 1, 2 and 3) and entering and leaving the multiple storage locations (Lanes 1, 2 and 3). A discussion below with reference to the location detection of the train unit 100 within the storage location (Lane 3) while the remaining storage locations (Lanes 1 and 2) remain unoccupied is discussed below with reference to FIG. 3.

FIG. 3 is a diagram of the train detection system 50 including the stored train unit 100 and storage locations (Lanes 1, 2 and 3) in accordance with one or more embodiments. Each of Lanes 1, 2 and 3 include a pair of first and second fixed transponders 201 through 205 and 202 through 206, and a pair of first and second antennas 161*a* through 161*c* and 162*a* through 162*c*. Lane 1 includes a first fixed transponder 201 and a second fixed transponder 203 and a first antenna 161*a* and a second antenna 161*b*; Lane 2 includes a first fixed transponder 203 and a second fixed transponder 204 and a first antenna 161*b* and a second antenna 162*b*; and Lane 3 includes a first fixed transponder 205 and a second fixed transponder 206 and a first antenna 161*c* and a second antenna 162*c*.

The first transponder interrogator 141 corresponds to the first antennas 161*a* through 161*c*, and the second transponder interrogator 142 corresponds to the second antennas 162*a* through 162*c*. The first and second antennas 161*a* through 161*c* and 162*a* through 162*c* are controlled by corresponding switch devices 151 and 152, via the controller 130, to transmit request signals from the first and second antennas 161*a* through 161*c* and 162*a* through 162*c* to the first and second fixed transponders 201 through 205 and 202 through 206 of the storage locations Lanes 1, 2 and 3.

The first antenna 161*a* through 161*c* of each storage location Lanes 1, 2 and 3 send request signals (i.e., interrogates) to the first fixed transponder 201 through 205 of each storage location Lanes 1, 2 and 3; and the second antenna 162*a* through 162*b* of each storage location Lanes 1, 2 and 3 send request signals to the second fixed transponder 202 through 206 at each of storage location Lanes 1, 2 and 3. As mentioned above, by independently sending request signals to the first and second fixed transponders 201 through 205 and 202 through 206, an accurate reading of the first and second fixed transponders 201 through 205 and 202 through 206 can be determined. The first and second RF switch devices 151 and 152 allow for a continuous change in reading of the first and second fixed transponders 201 through 205 and 202 through 206 by the first and second antennas 161*a* through 161*c* and 162*a* through 162*c*, to thereby detect a failure thereof at the storage locations Lanes 1, 2 or 3. The first transponder interrogator 141 scans the first fixed transponders 201 through 205 in a first predetermined order by sending a request signal via one of the first antennas 161*a* through 161*c* based on a switching operation of the first switch device 151, and the second transponder interrogator 142 scans the second fixed transponders 202 through 206 in a second predetermined order by sending a request signal via one of the second antennas 162*a* through 162*c* based on a switching operation of the second switch device 152. According to one or more embodiments, the first and second predetermined orders are sequential or random.

A detailed description of the scanning operation performed by the first and second transponder interrogators 141 and 142 is discussed below with reference to FIG. 3.

The first transponder interrogator 141 begins a scanning process in a first predetermined order in a first scanning direction (as indicated by arrow A). The controller 130 selects an initial switching position of the first switch device 151 to the first antenna 161*a*. The first transponder interrogator 141 scans the first fixed transponder 201 by sending a request signal from the first antenna 161*a* to the first fixed transponder 201 at a first storage location Lane 1 to determine whether the storage location Lane 1 is occupied. The first fixed transponder 201 is activated by the request signal and sends a response signal back to the first transponder interrogator 141 and the first transponder interrogator 141 sends a message signal back to the controller 130, and the controller 130 determines whether the storage location Lane 1 is occupied based upon whether the first fixed transponder 201 at the storage location Lane 1 is able to be scanned. If the storage location Lane 1, 2 or 3 is occupied, the first transponder interrogator 141 scans the first mobile transponder 101 instead of the first fixed transponder 201, 203 or 205. When an operation of the first fixed transponder 201 at the first storage location Lane 1 is verified by the controller 130, the controller 130 controls the first switch device 151 to switch to the first antenna 161*b*, and the first transponder interrogator 141 scans the first fixed transponder 203 at the storage location Lane 2 to verify, via the controller 130, the operation of the first fixed transponder 203. The controller 130 then controls the first switch device 151 to switch to the first antenna 161*c* and the first transponder interrogator 141 scans the first fixed transponder 205 at the storage location Lane 3 to verify, via the controller 130, the operation of the first fixed transponder 205. Since the train unit 100 is stored in the storage location Lane 3 the first transponder interrogator 141 is unable to scan the first fixed transponder 205 and therefore the controller 130 is unable to verify the operation thereof. Instead, the first transponder interrogator 141 scans the first mobile transponder 101. This scanning process of the first transponder interrogator 141 is continuously or periodically repeated at the fixed transponders 201 through 205 therefore operation of the fixed transponders 201 through 205 is detectable. The present disclosure is not limited to any particular number of storage locations and varies accordingly.

The second transponder interrogator 142 is configured to scan the second fixed transponders 202 through 206 also located at the storage locations Lanes 1, 2 and 3. According to one or more embodiments, the scanning operations of the first and second transponder interrogators 141 and 142 are performed simultaneously. In other embodiments, the scanning operations of the first and second transponder interrogators 141 and 142 are performed consecutively. Further, according to one or more embodiments, the second transponder interrogator 142 scans the second fixed transponders 202 through 206 in a second direction opposite the scanning direction of the first transponder interrogator 141 (as indicated by arrow B). The performance of the scanning operations in opposite directions decreases the detection time for detecting train movement. According to one or more embodiments, the scanning operations of the first and second transponder interrogators 141 and 142 are performed in the same direction.

As further shown in FIG. 3, the controller 130 controls the second switch device 152 to be in an initial position at second antenna 162*c*. The second transponder interrogator 142 begins scanning the second fixed transponder 206 to verify via the controller 130 an operation of the second fixed transponder 206. Similar to the scanning operation performed by the first transponder interrogator 141 of the first fixed transponder 205, the controller 130 is unable to verify the operation of the second fixed transponder 206 since the train unit 100 is stored in the storage location Lane 3. Instead, the second transponder interrogator 142 scans the mobile transponder 102 via the second antenna 162*c*, and the controller 130 determines that the storage location Lane 3 is occupied. The controller 130 then switches the second switch device 152 to the second antenna 162*b* to continue the scanning process of the second transponder interrogator 142 by scanning the second fixed transponder 204 of the storage location Lane 2 to verify, via the controller 130 the operation of the second fixed transponder 204. When the operation of the second fixed transponder 204 at the storage location Lane 2 is verified, the controller 130 controls the second switch device 152 to switch to the second antenna 162*a* and the second transponder interrogator 142 then scans the second fixed transponder 202 at the storage location Lane 1 to determine operability thereof.

According to one or more embodiments, the first fixed transponders 201, 203, and 205 are assigned odd-numbered identifiers and the second fixed transponders 202, 204 and 206 are assigned even-numbered identifiers for purposes of determining the fixed transponder being scanned by a corresponding first or second antenna.

According to one or more embodiments, when a specified storage location Lane 1, 2 or 3 is unoccupied, upon scanning, the first and second transponder interrogators 141 and 142 identify the first and second fixed transponders 201 through 205 and 202 through 206, at the specified storage locations Lane 1, 2 and 3. In this embodiment, because the storage location Lane 3 is occupied, the first and second transponder interrogators 141 and 142 identify the first and second mobile transponders 101 and 102 of the train unit 100 instead of the first fixed transponder 205 and the second fixed transponder 206.

A detection of location and train movement according to one or more embodiments will now be discussed below with reference to Table 1:

TABLE 1

| | Unoccupied | Stored | Moving | Moving |
|---|---|---|---|---|
| First Fixed Transponder (Odd) | V | NV | NV | V |
| Second Fixed Transponder (Even) | V | NV | V | NV |
| First Mobile Transponder (Front) | NV | V | V | NV |
| Second Mobile Transponder (Rear) | NV | V | NV | NV |

V represents Verified
NV represents Not Verified

As shown in Table 1, if the controller 130 verifies the operation of both the first and second fixed transponders at a specified storage location, then the storage location is unoccupied. If the controller 130 verifies the operation of the first and second mobile transponders of a train unit 100 at the storage location, then the storage location is occupied.

Further, as shown in Table 1, if the train unit 100 is moving into out from a specified storage location (e.g., Lane 3), the first transponder interrogator 141 or the second transponder interrogator 142 scans a corresponding first fixed transponder 205 or corresponding second fixed transponder 206, and the other of the first transponder interrogator 141 or the second transponder interrogator 142 scans the first or second mobile transponder 101 or 102 of the train unit 100 or fails to scan either a fixed transponder 205 or 206 or a mobile transponder 101 or 102. For example, if the first antenna 161*c* scans the first fixed transponder 205 and the controller 130 verifies operation of the first fixed transponder 205, and the second antenna 162*c* is not able to scan neither the second fixed transponder 206 nor the second mobile transponder 102, the train unit 100 is moving and a body of the train unit 100 is blocking the reading of the second fixed transponder 206, therefore the train unit 100 is moving (i.e., entering or leaving) the storage location Lane 3. According to another embodiment, if the first antenna 161*c* scans the first fixed transponder 205 and the controller 130 verifies operation of the first fixed transponder 205, and the second antenna 162*c* scans the second mobile transponder 102 and the controller 130 verifies operation of the second mobile transponder 102, then the train unit 100 is about to enter or leave the storage location Lane 3. According to one or more embodiments, a direction of movement of the train unit 100 is determined, via the controller 130 by sequence of the reading the first fixed transponders 201 through 205 or the second fixed transponders 202 through 206 and the mobile transponders 101 and 102 by the first and second transponder interrogators 141 and 142.

Figure 4:
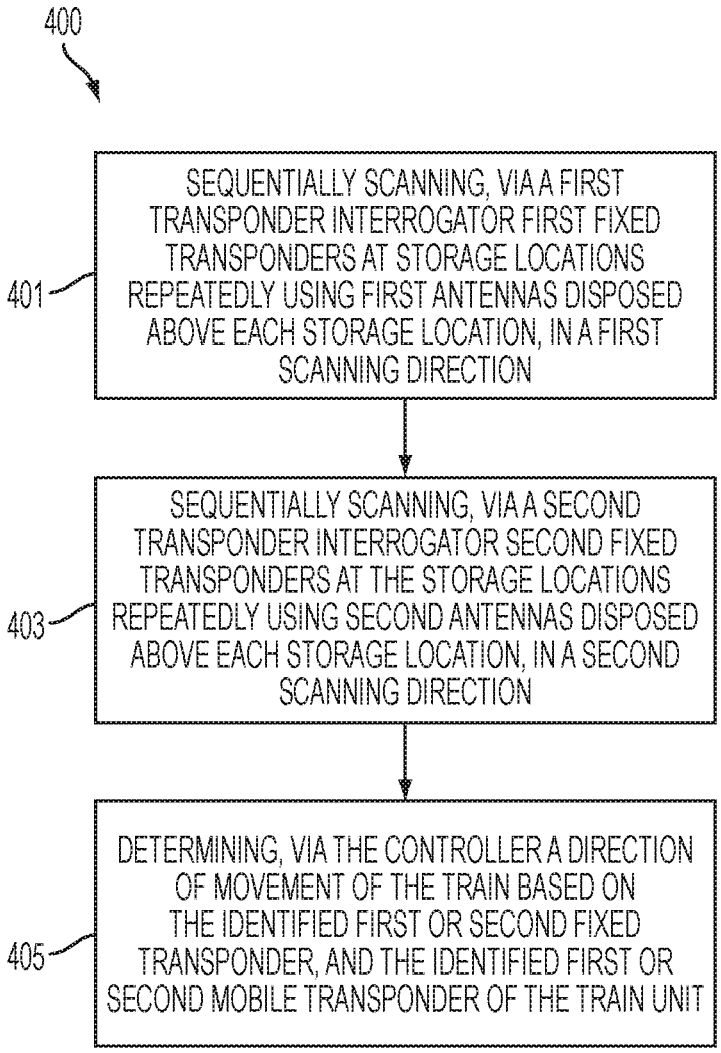
FIG. 4 is a flow diagram of a method of detecting train movement and location in accordance with one or more embodiments.

FIG. 4 is a flow diagram of a method of detecting train movement and location in accordance with one or more embodiments. As shown in method 400, at operation 401, the method begins with scanning via a first transponder interrogator 141, first fixed transponders 201 through 205 at storage locations Lane 1, 2 and 3 in a first predetermined order using first antennas 161*a* through 161*c* above each storage location Lane 1, 2 and 3, in a first scanning direction (arrow A) and scanning, via a second transponder interrogator 142, the second fixed transponders 202 through 206 at the storage locations Lane 1, 2, and 3 using the second antennas 162*a* through 162*c* also above each storage location Lane 1, 2 and 3, in a second scanning direction (arrow B). According to one or more embodiments, the first and second predetermined orders are sequential or random. According to one or more embodiments, the second scanning direction is opposite the first scanning direction. As mentioned above, according to one or more embodiments, the scanning operations of the first and second transponder interrogators 141 and 142 are performed repeatedly either periodically or continuously over a predetermined period of time.

In operation 401, scanning the first and second fixed transponders comprises generating, via the first transponder interrogator 141, one or more request signals for transmission, by the first antenna 161*a*, above the storage location Lane 1, toward the first fixed transponder 201 at the storage location Lane 1; and generating, via the second transponder interrogator 142, one or more request signals for transmission, by the second antenna 162*b* above the storage location Lane 2, toward the second fixed transponder 204 at the storage location Lane 2.

Further according to one or more embodiments, in operation 401, scanning the first and second fixed transponders 201 through 205 and 202 through 206 further comprises receiving a control signal from the controller 130, at a first RF switch device 151 and a second RF switch device 152, between the first and second transponder interrogators 141 and 142, and the first and second antennas 161*a* through 161*c* and 162*a* through 162*c*, to switch to a corresponding first antenna 161*a* through 161*c* or second antenna 162*a* through 162*c* for transmission of the one or more request signals to the first and second fixed transponders 201 through 205 and 202 through 206.

From operation 401, the process continues to operation 403 where operation of the train detection system 50 is verified via the controller 130, based on the scanning performed in operation 401. In operation 403, verifying operation of the train detection system is performed based on receipt of one or more message signals responsive to transmission of the one or more request signals from the first and second transponder interrogators 141 and 142.

Further, in operation 403, verifying operation of the train detection system 50 comprises verifying operation of the first and second fixed transponders 201-205 and 202-206 and the first and second transponder interrogators 141 and 142.

In operations 401 and 403, scanning the first fixed transponders comprises scanning a first fixed transponder 201 at a first storage location Lane 1, and if the controller 130 verifies operation of the first fixed transponder 201 at the first storage location Lane 1, scanning the first fixed transponder 203 at a second storage location Lane 2. This scanning process is continued until the first fixed transponders 201-205 have been scanned for all storage locations Lanes 1, 2 and 3. Further, the scanning the second fixed transponders 202-206 at the storage locations Lanes 1, 2 and 3 comprises scanning a second fixed transponder 206 at the storage location Lane 3 (i.e., the last storage location), and if the controller 130 verifies operation of the second fixed transponder 206 at the storage location Lane 3, scanning and verifying operation of the second fixed transponder 204 at the storage location Lane 2, and then scanning and verifying operation of the second fixed transponder 202 at the storage location Lane 1. When a specified storage location Lane 1, 2 or 3 is unoccupied, upon scanning, identifying the first and second fixed transponders 201 through 205 and 202 through 206, at the specified storage location Lane 1, 2 or 3, and when a specified storage location Lane 1, 2 or 3 is occupied, upon scanning, identifying the first and second mobile transponders 101 or 102 of the train unit 100.

Further, when the train unit 100 is moving into or from a specified storage location Lane 1, 2 or 3, upon scanning, identifying the first fixed transponder 201 through 205 or the second fixed transponder 202 through 206 with the corresponding first transponder interrogator 141 or the second transponder interrogator 142, and identifying one of the first or second mobile transponders 101 or 102 of the train unit 100.

The process continues to operation 405 where a direction of movement of the train unit 100 is determined, via the controller 130, based on the identified first or second fixed transponder 201 through 205 or 202 through 206, and the identified first or second mobile transponder 101 or 102 of the train unit 100.

According to one or more embodiments, the controller 130 determines a location and movement of the train unit 100 independently of communication with the VOBC of the train unit 100. Therefore, in cases when the VOBC is non-operational or in shutdown period, the train detection system 50 is able to detect a location of the train unit 100 based only on the scanning operations of the first and second transponder interrogators 141 and 142.

In other embodiments, the controller 130 actively communicates with the VOBC of the train unit 100 to verify the train location information of the VOBC and to restart the VOBC without having to re-localize or manually move the train unit 100.

Figure 5:
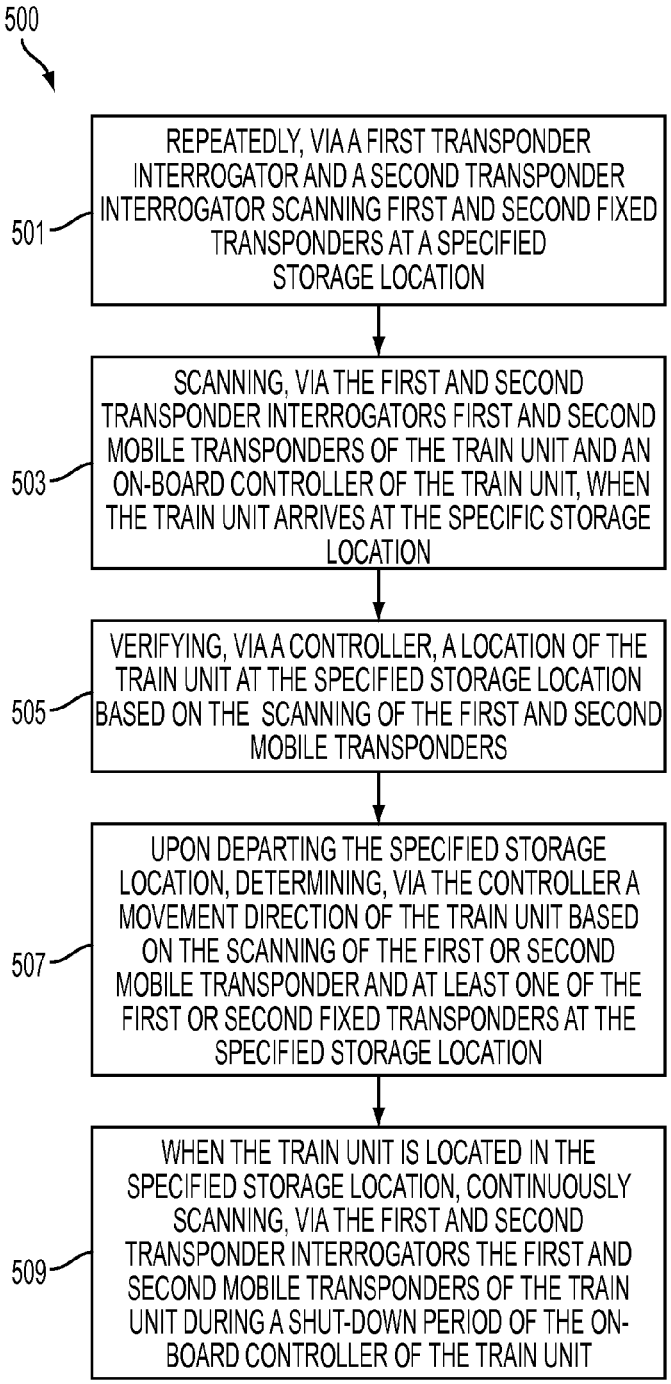
FIG. 5 is a flow diagram of a method of detecting train movement and location in accordance with alternative embodiments.

FIG. 5 is a flow diagram of a method of detecting train movement and location in accordance with alternative embodiments.

The method 500 begin at operation 501 by scanning via the first and second transponder interrogators 141 and 142, first and second fixed transponders 201 through 205 and 202 through 206 at specified storage locations Lanes 1, 2 and 3. The process continues to operation 503 where the first and second mobile transponders 101 and 102 of the train unit 100 are scanned via the first and second transponder interrogators 141 and 142 and the VOBC of the train unit 100 is in communication with the controller 130, if the train unit 100 arrives at the specified storage location Lane 1, Lane 2 or Lane 3.

In operation 505, the process continues where a location of the train unit 100 is determined, via the controller 130, at the specified storage location Lane 1, 2 or 3 based on the scanning of the first and second mobile transponders 101 and 102.

According to one or more embodiments, the location of the train unit 100 is determined, via the controller 130, based on the scanning of the first and second mobile transponders 101 and 102 of the train unit 100 and the communication with the VOBC of the train unit 100 when the VOBC is operational.

In operation 507, upon departing the specified storage location Lane 1, 2 or 3, a movement direction of the train unit 100 is determined, via the controller 130, based on the scanning of the first or second mobile transponder 101 or 102 and at least one of the first or second fixed transponders 201 through 205 and 202 through 206 at the specified storage locations Lanes 1, 2 and 3.

In operation 509, if it is determined, via the controller 130, that the train unit 100 is located in the specified storage location Lanes 1, 2 or 3, the first and second mobile transponders 101 and 102 of the train unit 100 are continuously scanned during a shut-down period of the VOBC of the train unit 100. And upon re-starting the VOBC, a location of the train unit 100 is able to be confirmed based on the scanning of the first and second mobile transponders 101 and 102. According to one or more embodiments, if the train unit 100 parked in the storage location 1, 2 or 3 is shut down either manually, or under the control of the controller 130, the controller 130 has the location information of the train unit 100 associated with VOBC of the train unit 100 and continuously scanning of the mobile transponders 101 and 102 of the train unit 100. Therefore once the VOBC terminates communication (e.g., shuts down), the controller 130 continuously monitors the reading of the mobile transponders 101 and 102 to ensure that the train unit 100 is stationary at the storage location Lane 1, 2 or 3. If the train unit 100 moves without restarting the VOBC, the controller 130 is able to detect the direction of movement by the sequence of the transponders (e.g., first and second fixed transponders 201 through 205 and 202 through 206 and mobile transponders 101 and 102) detected.

If the VOBC of the train unit 100 is restarted at a storage location Lane 1, 2 or 3 and the VOBC cannot determine whether the train unit 100 has moved during the shutdown period, the controller 130 confirms the location and movement of the train unit 100 upon re-establishing communication with the VOBC. The location information of the VOBC can be confirmed by the location information obtained by the controller 130 via the first and second transponder interrogators 141 and 142.

According to one or more embodiments, if the train unit 100 having a shutdown VOBC moves to a different storage location Lane 1, 2 or 3, the controller 130 determines the new storage location Lane 1, 2 or 3 and identifies the train unit 100 upon re-establishing communication with the VOBC of the train unit 100.

Since the first and second fixed transponders 201 through 206 are continuously scanned, operability of the first antennas 161*a* through 161*c* and the second antennas 162*a* through 162*c*, the first and second switch devices 151 and 152 and the first and second transponder interrogators 141 and 142 is verified for failure detection of the train detection system 50 and for safety measures. One or more embodiments disclose a train detection system for detecting a train unit, comprising a first transponder interrogator configured to generate one or more request signals for transmission, by a first antenna above a first track location, toward a first fixed transponder at the first track location; a second transponder interrogator configured to generate one or more request signals for transmission, by a second antenna above a second track location, toward a second fixed transponder at the second track location; and a controller communicably connected with the first and second transponder interrogators and configured to verify operation of the train detection system based on receipt of one or more message signals responsive to transmission of the one or more request signals from the first and second transponder interrogators.

One or more embodiments disclose a train detection system, comprising at least a first mobile transponder and a second mobile transponder mounted at opposite ends on a train unit; a first fixed transponder and a second fixed transponder mounted at first and second track locations; a first antenna and a second antenna above corresponding first and second track locations; a first transponder interrogator configured to generate one or more request signals for transmission, by the first antenna above the first track location, toward the first fixed transponder at the first track location; a second transponder interrogator configured to generate one or more request signals for transmission, by the second antenna above the second track location, toward the second fixed transponder at the second track location; and a controller communicably connected with the first and second transponder interrogators and configured to verify operation of the train detection system based on receipt of one or more message signals responsive to transmission of the one or more request signals from the first and second transponder interrogators.

One or more embodiments disclose a method for detecting train movement and location of a train unit having first and second mobile transponders mounted thereon using a train detection system, the method comprising scanning, via a first transponder interrogator, first fixed transponders at first and second track locations in a first predetermined order, using a first antenna above each first and second track location, and scanning, via a second transponder interrogator, second fixed transponders at first and second track locations in a second predetermined order, using second antenna above each first and second track location; and verifying, via a controller operation of the train detection system based on the scanning.

One or more embodiments disclose a method for detecting train movement and location of a train unit having first and second mobile transponders mounted thereon using a train detection system, the method comprising scanning, via a first transponder interrogator and a second transponder interrogator, first and second fixed transponders at a specified track location; scanning, via the first and second transponder interrogators, first and second mobile transponders of the train unit and communicating between a controller of the train detection system and an on-board controller of the train unit, if the train unit arrives at the specific track location; and verifying, via the controller, a location of the train unit at the specified track location based on the scanning of the first and second mobile transponders.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A train detection system for detecting a train unit, comprising:

a first transponder interrogator configured to generate one or more request signals for transmission, by a first antenna above a first track location, toward a first fixed transponder at the first track location;

a second transponder interrogator configured to generate one or more request signals for transmission, by a second antenna above a second track location, toward a second fixed transponder at the second track location; and a controller communicably connected with the first and second transponder interrogators and configured to verify operation of the train detection system based on receipt of one or more message signals responsive to transmission of the one or more request signals from the first and second transponder interrogators.

2. The train detection system of claim 1, wherein verifying operation of the train detection system comprises verifying operation of the first and second fixed transponders and the first and second transponder interrogators.

3. The train detection system of claim 1, wherein the train detection system further comprises:

a first switch device and a second switch device controlled by the controller, and corresponding to first and second antennas and the first and second transponder interrogators, wherein the first and second switch devices each receive a control signal from the controller and switch to a corresponding first antenna or second antenna for transmission of the one or more request signals to the first and second fixed transponders.

4. The train detection system of claim 1, wherein the first and second antennas communicate with first and second mobile transponders mounted at opposite ends of the train unit, if the train unit is parked at the first or second track locations, or the first and second fixed transponders if the train unit is moved from the first or second track locations.

5. The train detection system of claim 4, wherein the first and second antennas communicate with the first and second mobile transponders or the first and second fixed transponders based on a direction of the train movement.

6. The train detection system of claim 4, wherein the first and second transponder interrogators are isolated from each other and operate at different frequencies.

7. The train detection system of claim 2, wherein the first transponder interrogator is configured to scan the first fixed transponder at the first track location, and if the controller verifies operation of the first fixed transponder at the first track location, the first switch device switches the first transponder interrogator to scan a first fixed transponder at the second track location.

8. The train detection system of claim 3, wherein the second transponder interrogator is configured to scan the second fixed transponder at the second track location, and if the controller verifies operation of the second fixed transponder at the second track location, the second switch device switches the second transponder interrogator to scan a second fixed transponder at the first track location.

9. The train detection system of claim 8, wherein if the first or second track location is unoccupied, upon scanning, the first and second transponder interrogators identify the first and second fixed transponders at the first or second track location.

10. The train detection system of claim 8, wherein if the first or second track location is occupied, upon scanning, the first and second transponder interrogators identify the first and second mobile transponders of the train unit at the first or second track location.

11. The train detection system of claim 8, wherein if the train is moving into or from the first or second track location, one of the first transponder interrogator or the second transponder interrogator is configured to scan a corresponding first fixed transponder or corresponding second fixed transponder, and the other of the first transponder interrogator or the second transponder interrogator is configured to scan the first or second mobile transponder of the train unit.

12. The train detection system of claim 11, wherein a direction of movement of the train unit is determined by reading the first fixed transponder or the second fixed transponder and identifying, via the controller, a sequence of scanning by the first and second transponder interrogators.

13. A train detection system, comprising:

at least a first mobile transponder and a second mobile transponder mounted at opposite ends on a train unit;

a first fixed transponder and a second fixed transponder mounted at first and second track locations;

a first antenna and a second antenna above corresponding first and second track locations;

a first transponder interrogator configured to generate one or more request signals for transmission, by the first antenna above the first track location, toward the first fixed transponder at the first track location;

a second transponder interrogator configured to generate one or more request signals for transmission, by the second antenna above the second track location, toward the second fixed transponder at the second track location; and a controller communicably connected with the first and second transponder interrogators and configured to verify operation of the train detection system based on receipt of one or more message signals responsive to transmission of the one or more request signals from the first and second transponder interrogators.

14. The train detection system of claim 13, wherein the train detection system further comprises:

a first switch device and a second switch device controlled by the controller, and corresponding to first and second antennas and the first and second transponder interrogators, wherein the first and second switch devices each receive a control signal from the controller and switch to a corresponding first antenna or second antenna for transmission of the one or more request signals to the first and second fixed transponders.

15. A method of detecting train movement and location of a train unit having first and second mobile transponders mounted thereon using a train detection system, the method comprising:

scanning, via a first transponder interrogator, first fixed transponders at first and second track locations in a first predetermined order, using a first antenna above each first and second track location, and scanning, via a second transponder interrogator, second fixed transponders at first and second track locations in a second predetermined order, using second antenna above each first and second track location; and verifying, via a controller operation of the train detection system based on the scanning.

16. The method of claim 15, wherein the first predetermined order and the second predetermined order are sequential or random.

17. The method of claim 15, wherein a scanning direction of the second transponder interrogator is opposite a scanning direction of the first transponder interrogator.

18. The method of claim 15, wherein scanning is performed continuously.

19. The method of claim 15, wherein scanning the first and second fixed transponders and verifying the operation of the train detection system comprise:

generating, via the first transponder interrogator, one or more request signals for transmission, by the first antenna above the first track location, toward the first fixed transponder at the first track location; and generating, via the second transponder interrogator, one or more request signals for transmission, by the second antenna above the second track location, toward the second fixed transponder at the second track location; and verifying, via the controller, operation of the train detection system based on receipt of one or more message signals responsive to transmission of the one or more request signals from the first and second transponder interrogators.

20. The method of claim 19, wherein scanning the first and second fixed transponders further comprises:

receiving a control signal from the controller, at a first switch and a second switch between the first and second transponder interrogators and the first and second antennas, to switch to a corresponding first antenna or second antenna for transmission of the one or more request signals to the first and second fixed transponders.

21. The method of claim 15, wherein verifying operation of the train detection system, comprises:

verifying operation of the first and second fixed transponders and the first and second transponder interrogators.

22. The method of claim 21, wherein scanning the first fixed transponders further comprises:

scanning the first fixed transponder at the first track location, and if the controller verifies the operation of the first fixed transponder at the first track location, scanning the first fixed transponder at a second track location.

23. The method of claim 21, wherein scanning the second fixed transponders at the storage locations further comprises:

scanning the second fixed transponder at the second track location, and if the controller verifies the operation of the second fixed transponder at the second track location, scanning the second fixed transponder at the first storage location.

24. The method of claim 23, wherein if the first or second track location is unoccupied, upon scanning, identifying the first and second fixed transponders at the first or second track location.

25. The method of claim 23, wherein if the first or second track location is occupied, upon scanning, identifying the first and second mobile transponders of the train unit at the first or second track location.

26. The method of claim 23, wherein if the train is moving into or from the first or second track location, upon scanning, identifying the first fixed transponder or the second fixed transponder, and identifying one of the first or second mobile transponders of the train unit.

27. The method of claim 26, further comprising:

determining, via the controller a direction of movement of the train based on the identified first or second fixed transponder, and the identified first or second mobile transponder of the train unit.

28. A method of detecting train movement and location of a train unit having first and second mobile transponders mounted thereon using a train detection system, the method comprising:

scanning, via a first transponder interrogator and a second transponder interrogator, first and second fixed transponders at a specified track location;

scanning, via the first and second transponder interrogators, first and second mobile transponders of the train unit and communicating between a controller of the train detection system and an on-board controller of the train unit, if the train unit arrives at the specific track location; and verifying, via the controller, a location of the train unit at the specified track location based on the scanning of the first and second mobile transponders.

29. The method of claim 28, wherein the location of the train unit is verified based on the scanning of the first and second mobile transponders of the train unit and communication with the on-board controller of the train unit if operational.

30. The method of claim 28, further comprising:

upon departing the specified track location, determining, via the controller, a movement direction of the train unit based on the scanning of the first or second mobile transponder and at least one of the first or second fixed transponders at the track storage location.

31. The method of claim 28, wherein if the train unit is located in the specified track location, continuously scanning, via the first and second transponder interrogators the first and second mobile transponders of the train unit during a shutdown period of the on-board controller of the train unit.

* * * * *